United States Patent [19]

Keintzel et al.

[11] Patent Number: 4,683,842

[45] Date of Patent: Aug. 4, 1987

[54] APPARATUS FOR DRYING WET STEAM AND SUBSEQUENTLY SUPERHEATING THE DRIED STEAM

[75] Inventors: Günter Keintzel, Engelskirchen; Klaus Westebbe, Gummersbach, both of Fed. Rep. of Germany

[73] Assignee: L. & C. Steinmüller GmbH, Gummersbach, Fed. Rep. of Germany

[21] Appl. No.: 897,401

[22] Filed: Aug. 18, 1986

[30] Foreign Application Priority Data

Aug. 30, 1985 [DE] Fed. Rep. of Germany ..... 3531054

[51] Int. Cl.[4] ..... F22G 4/00

[52] U.S. Cl. ..... 122/483; 55/269; 55/440; 122/34; 122/491

[58] Field of Search ..... 122/491, 492, 483, 34, 122/33; 55/269, 440

[56] References Cited

U.S. PATENT DOCUMENTS 4,250,841 2/1981 Bessouat et al. ..... 122/483
4,273,077 6/1981 Bessouat et al. ..... 122/483
4,589,893 5/1986 Franzolini et al. ..... 122/483 X

*Primary Examiner*—Edward G. Favors
*Attorney, Agent, or Firm*—Becker & Becker, Inc.

[57] ABSTRACT

An apparatus for drying wet steam and subsequently superheating the dried steam. The apparatus includes a cylindrical tank, a separator that is disposed in the tank for receiving wet steam and removing water therefrom, and a superheater disposed in the tank for receiving dry steam from the separator. The superheater is provided with a plurality of tube bundles, some of which are part of first superheater stage, and the rest are part of a second superheater stage. The tube bundles form a channel in the center of the tank. Outwardly disposed deflectors are disposed in, and extend in the longitudinal direction of, the tank. These deflectors are associated with the tube bundles in such a way that dry steam from the separator flows, from the outside, inwardly through the tube bundles of the first superheater stage, and into the central channel, and from there, from the inside, outwardly through the tube bundles of the second superheater stage.

9 Claims, 5 Drawing Figures

APPARATUS FOR DRYING WET STEAM AND SUBSEQUENTLY SUPERHEATING THE DRIED STEAM

BACKGROUND OF THE INVENTION

The present invention relates to an apparatus for drying wet steam and subsequently superheating the dried steam.

An apparatus of this type, having a cylindrical tank, a separator disposed in the tank, and a superheater disposed next to the separator in the tank, and comprising a plurality of tube bundles is known, for example, from U.S. Pat. No. 4,103,647, which belongs to the assignee of the present application. With this known apparatus, it is possible to have only a single stage superheating of the dried steam, because the central channel is provided as a flow-in channel for all of the tube bundles, with the dried steam flowing into this channel from below. Since in the channel the steam must be distributed over the entire axial length of the tube bundles, from which the steam exits outwardly essentially radially from the inside, the channel must have a relatively large cross-sectional area in order to accommodate an axially directed flow.

It is an object of the present invention to provide an apparatus of the aforementioned general type where it is possible to have a two-stage superheating in the superheater, and where it is possible to have a relatively small overall size of the tank.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
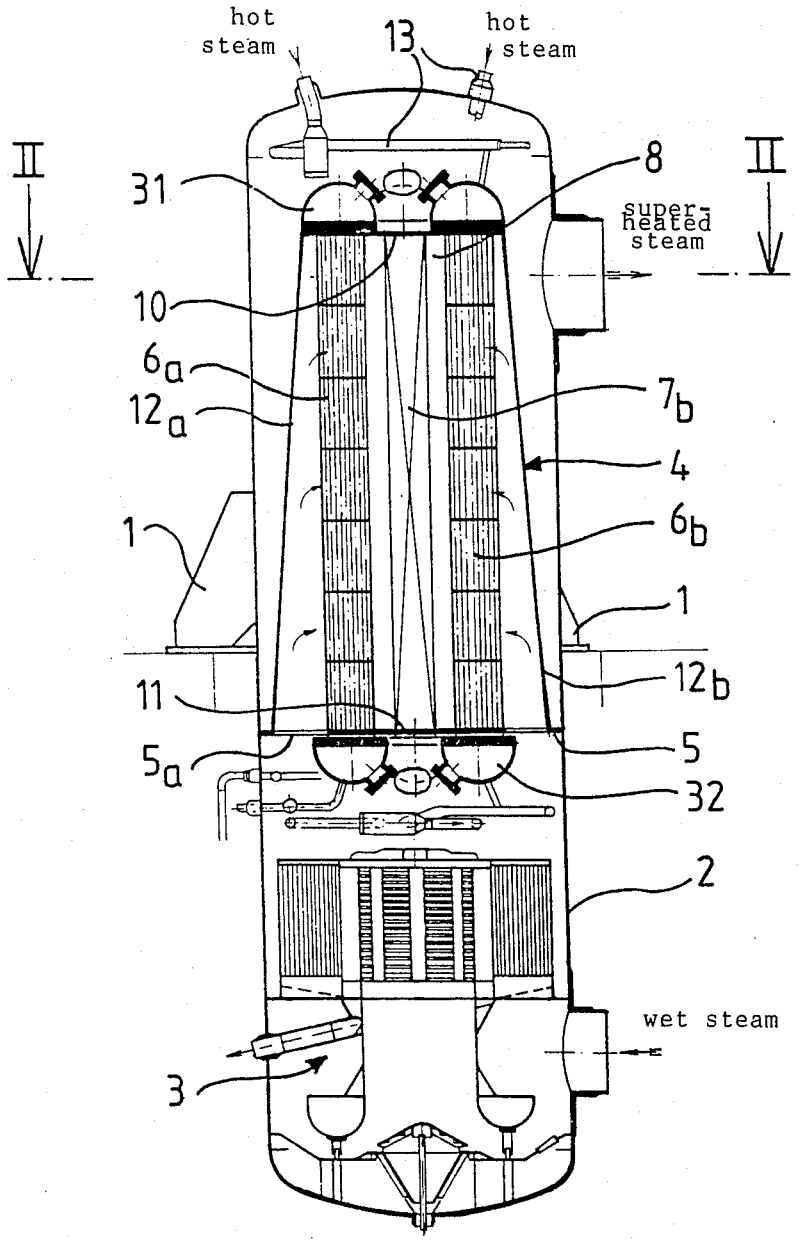
FIG. 1 is a vertical cross-sectional view through an upright exemplary embodiment of the inventive apparatus.

The inventive apparatus for drying wet steam and subsequently superheating the dried steam comprises: a cylindrical tank; a separator disposed in the tank for receiving wet steam and removing water therefrom; a superheater disposed in the tank for receiving dry steam from the separator, with the superheater being provided with a plurality of tube bundles, some of which are part of a first superheater stage, and the rest being part of a second superheater stage, with the tube bundles forming a channel in the center of the tank; and outwardly disposed deflector means that are disposed in, and extend in the longitudinal direction of, the tank, and are associated with the tube bundles in such a way that dry steam from the separator flows, from the outside, inwardly through the tube bundles of the first superheater stage and into the central channel, and from there, from the inside, outwardly through the tube bundles of the second superheater stage. The tank can be upright or horizontal.

In the inventive arrangement, the tube bundles of the superheater stages are disposed about the central channel, which serves as a discharge channel for the tube bundles of the first superheater stage, and serves as an in-flow channel for the tube bundles of the second superheater stage. There is essentially no axial flow in the central channel, because the steam that exits the tube bundles of the first stage enters the tube bundles of the second stage in essentially the same plane transverse to the direction of orientation of the tank. This permits a relatively small overall size for the tank.

The cross-sectional shape of the in-flow chamber for the superheater tube bundles of the first stage, which inflow chamber is delimited by the deflector means, preferably decreases in the in-flow direction parallel to the central axis of the tank. In a similar manner, the collecting chamber for the steam exiting the second stage of the superheater, which collecting chamber is defined between thc deflector means and the inner wall of the tank, increases in size from the bottom toward the top.

The steam deflector means are expediently provided with a conical shape.

It also appears expedient to associate a respective steam deflector means with each of the tube bundles of the first stage. A particularly simple configuration for the arrangement of the tube bundles of the two stages can be achieved if the bundles of the first and second stages alternate with one another.

However, other considerations are also conceivable. For example, at least two tube bundles of the first stage and/or two tube bundles of the second stage can be disposed next to one another.

Preferably, the exit for the dried and superheated steam is disposed at the upper end of the tank.

Further specific features of the present invention will be described in detail subsequently.

DESCRIPTION OF PREFERRED EMBODIMENTS

Referring now to the drawings in detail, a separator 3 is disposed in the lower region of the vertical, upright tank 2, which is supported by three brackets 1. Wet steam flows into the separator 3 in the direction of the arrow. Details of the construction of the separator 3 for an upright apparatus can be obtained from the aforementioned U.S. Pat. No. 4,103,647. For a horizontal apparatus, a separator of the type described in U.S. Pat. No. 4,576,125, which also belongs to the assignee of the present application, can be used. These patents are hereby incorporated into this specification by this reference to them. Disposed above the separator 3 is a superheater 4 that is supported on a support plate 5 that in turn is secured to the wall of the tank, for example by being welded thereto.

Figure 2:
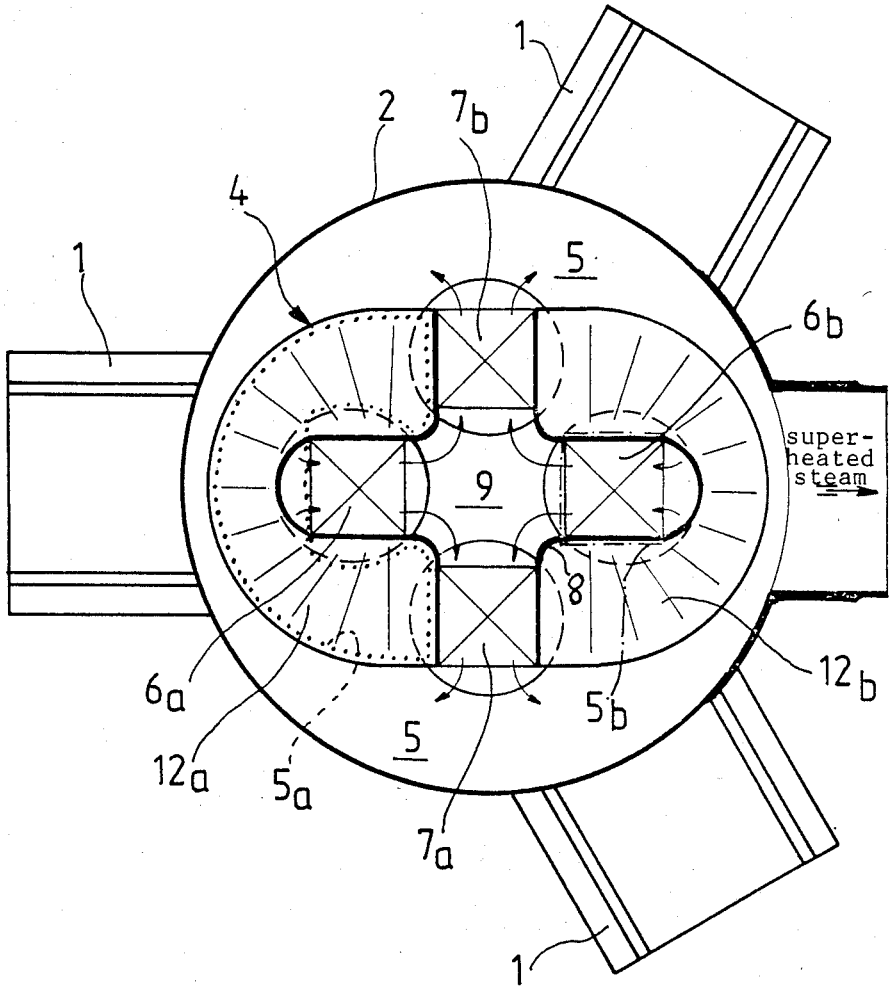
FIG. 2 is an enlarged cross-sectional view taken along line II—II in FIG. 1.

In the embodiment illustrated in FIGS. 1 and 2, the superheater 4 is provided with two tube bundles **6*a* and 6*b* that form the first superheater stage and are opposite one another. Also provided are two superheater tube bundles 7*a* and 7*b*** that form the second superheater stage.

As can be seen in FIG. 2, the tube bundles, which are arranged in the shape of a cross, are interconnected by steam guides or deflectors 8 in such a way that the tube bundles **6*a*, 6*b*, 7*a*, and 7*b*, together with the deflectors 8, define a central channel 9, the upper end of which is closed off by a plate 10, and the lower end of which is closed off by the support plate 5**.

As can be seen from FIGS. 1 and 2, steam deflectors 12*a* and 12*b*, which have a cross-sectional shape that tapers conically toward the top, are associated with the tube bundles 6*a* and 6*b* of the first stage. Dry steam flows into the flow-in chamber of the deflectors 12*a*, 12*b* from below through openings 5*a* in the support plate 5. The dry steam can flow from the outside inwardly through the tube bundles 6*a* and 6*b* and into the central channel 9. The steam that has been superheated in the first stage flows, for further heating, out of this central channel 9, in the direction of the arrows indicated in FIG. 2, into the tube bundles 7*a* and 7*b*. From there, the steam exits into the annular space that remains between the deflectors 12*a*, 12*b* and the inner wall. The cross-sectional shape of this space increases in a direction opposite to the decrease of the in-flow chamber into the tube bundles of the first stage; in other words, the annular space becomes larger from the bottom toward the top. The superheated steam is withdrawn from the upper region of the pressure tank.

The tube bundles 6*a*–7*b* are supplied in a known manner with hot steam. Schematically illustrated in FIG. 1 are two feed lines 13 at the upper end, and a collector at the bottom end.

Figure 3:
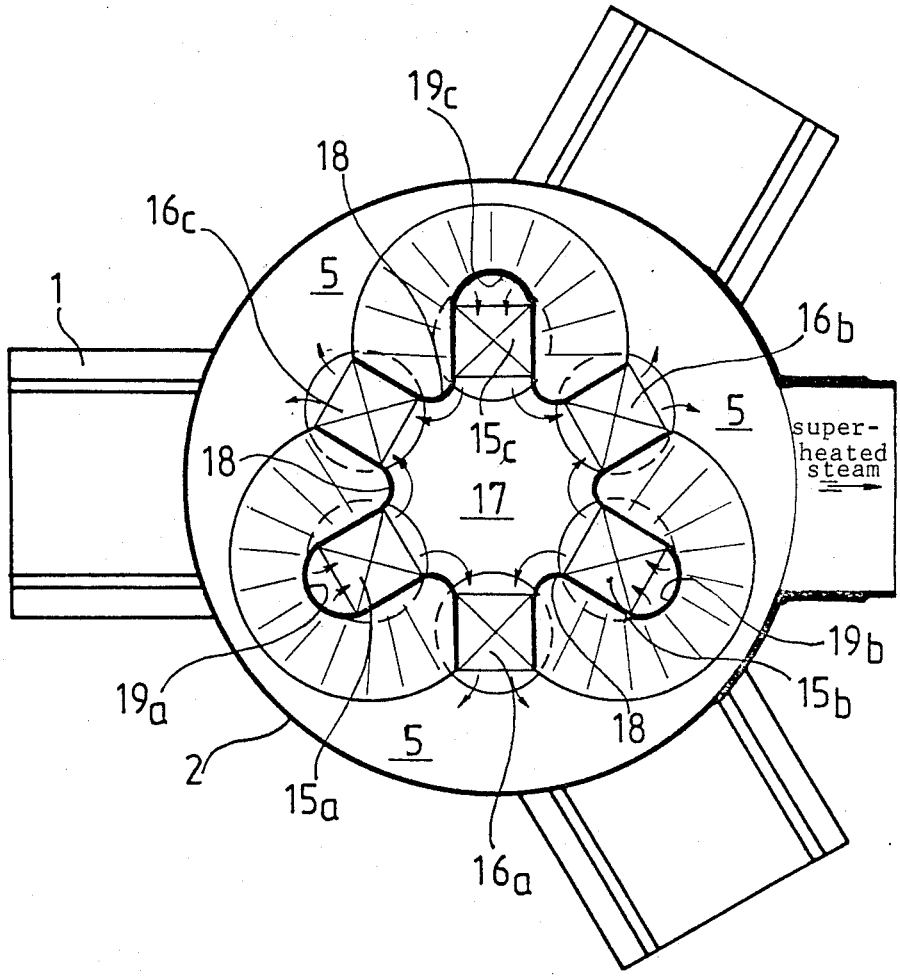
FIG. 3 is a cross-sectional view similar to that of FIG. 2 through a second inventive embodiment.

Whereas in the embodiment of FIGS. 1 and 2, four tube bundles are arranged in the shape of a cross, in the embodiment of FIG. 3 six tube bundles are arranged in an alternating fashion, with the tube bundles 15*a*, 15*b*, and 15*c* forming the first stage, while the tube bundles 16*a*, 16*b*, and 16*c* form the second stage. To define the central channel 17, the inner edges of the tube bundles are again provided with steam deflectors 18, while a conical deflector 19 is associated with each of the tube bundles 15*a*, 15*b*, and 15*c*.

Figure 4:
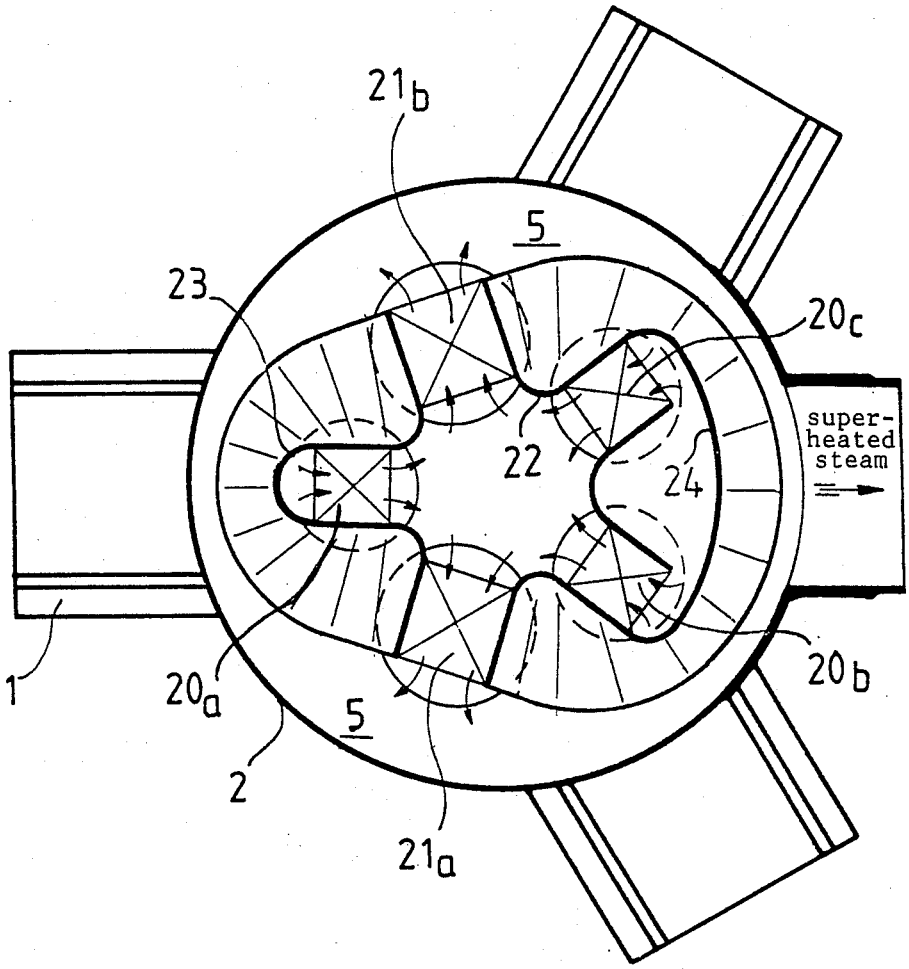
FIG. 4 is a cross-sectional view similar to that of FIG. 2 through a third inventive embodiment.

In the embodiment of FIG. 4, an odd number of tube bundles is provided. The first stage is formed by the tube bundles 20*a*, 20*b*, and 20*c*, with the tube bundles 20*b* and 20*c* being disposed next to one another. Associated with the tube bundles 20, which have a smaller cross-sectional area, are two tube bundles 21*a* and 21*b* which, as the second stage, have a larger cross-sectional shape. The internal or central channel is defined by the tube bundles 20 and 21, as well as steam deflectors 22. A steam deflector 23 is associated with the tube bundle 20*a*, and a steam deflector 24 is associated with the two adjacent tube bundles 20*b* and 20*c*.

Figure 5:
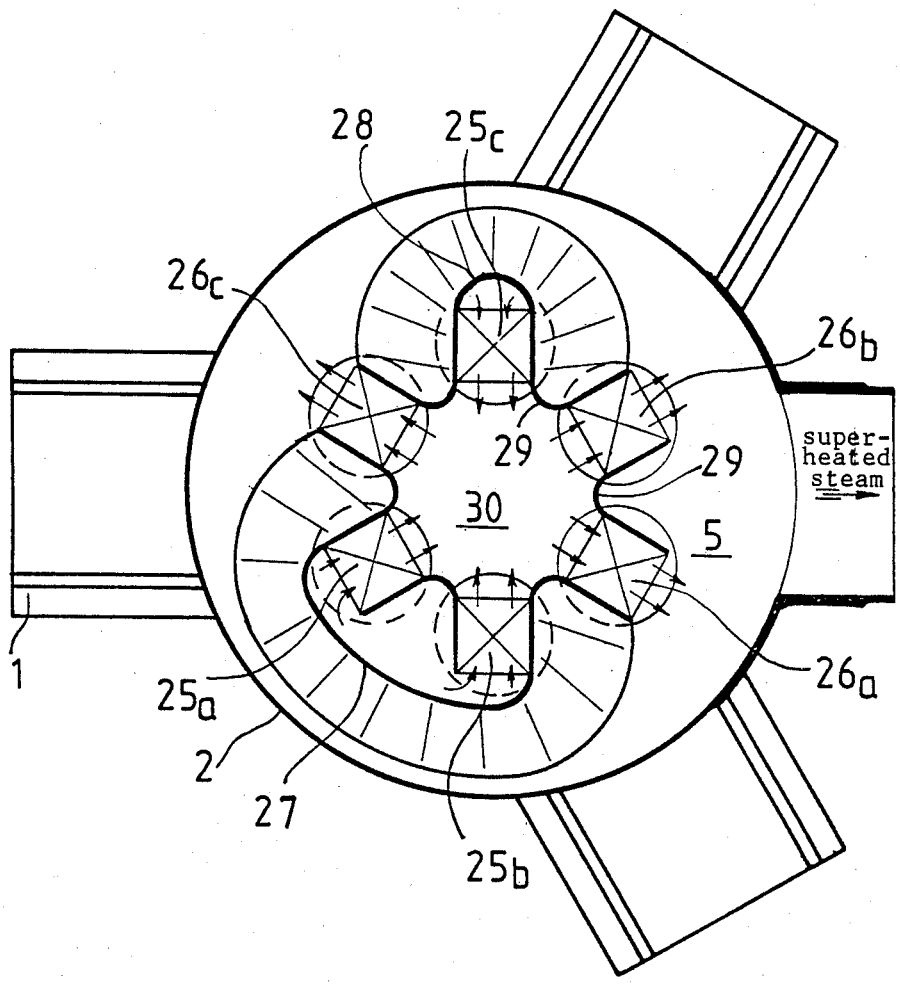
FIG. 5 is a cross-sectional view similar to that of FIG. 2 through a fourth inventive embodiment.

In the embodiment of FIG. 5, the tube bundles, which are the same size, are not alternately disposed as was the case in the embodiment of FIG. 3. Rather, two bundles 26*a* and 26*b* of the second stage follow two bundles 25*a* and 25*b* of the first stage when viewed in the circumferential direction. Following the bundle 26*b* is a bundle 25*c* and then a bundle 26*c*. A steam deflector 27 is associated with the bundles 25*a* and 25*b*, and a steam deflector 28 is associated with the bundle 25*c*. All of the bundles together, along with steam deflectors 29, again define a central channel 30. As is evident from the described drawings, an essential feature of the present invention is that the space between the superheater and the inner wall of the tank is divided by the conical steam deflectors into a flow-in chamber for the dry steam coming from the separator, and a discharge chamber for the superheated steam, while the central, axially extending channel of the first stage serves as a discharge chamber and the second stage serves as a flow-in chamber, without significant long flows building up in this chamber. The inner or central channel can thus have a relatively small cross-sectional area.

It should finally be noted that the upper ends of the tube bundles are supported on the support plate 5 via their crowns 31, which are interconnected by the cover plate 10, and via the outwardly disposed steam deflectors of the aforementioned embodiments, such as the deflectors 12*a* and 12*b* of FIG. 1.

In a sealed manner, the tube bundles are guided above their lower ends 32 through appropriate openings 5*b* in the support plate 5 in such a way that a relative expansion is possible between the bundles and the outwardly disposed and supported steam deflectors (such as the deflectors 12*a*, 12*b* in FIG. 1). In FIG. 2, the openings 5*a* are indicated by dotted lines, and the openings 5*b* are indicated by dot-dash lines. The circles indicated in the cross-sectional views of FIGS. 2–5 schematically represent the ends 32 of the bundles.

The present invention is, of course, in no way restricted to the specific disclosure of the specification and drawings, but also encompasses any modifications within the scope of the appended claims.

What we claim is:

1. An apparatus for drying wet steam and subsequently superheating the dried steam, comprising:

a cylindrical tank;

a separator disposed in said tank for receiving wet steam and removing water therefrom;

a superheater disposed in said tank for receiving dry steam from said separator; said superheater is provided with a plurality of tube bundles, some of which are part of a first superheating stage, with the rest being part of a second superheating stage; said tube bundles extend in the longitudinal direction of said tank, and form a channel in the center of said tank; and deflector means that are disposed in said tank outwardly of said tube bundles; said deflector means extend in the longitudinal direction of said tank, and are associated with said tube bundles in such a way that dry steam from said separator flows, from the outside, inwardly through the tube bundles of said first superheating stage and into said central channel, and from there, from the inside, outwardly through the tube bundles of said second superheating stage.

2. An apparatus according to claim 1, in which said deflector means define a flow-in chamber for said tube bundles of said first superheating stage, with the cross-sectional area of said flow-in chamber decreasing in the direction of flowing-in dry steam parallel to the longitudinal direction of said tank.

3. An apparatus according to claim 2, in which said deflector means have a conical shape.

4. An apparatus according to claim 2, in which a respective one of said deflector means is associated with each of said tube bundles of said first superheating stage.

5. An apparatus according to claim 4, in which said tube bundles of said first superheating stage alternate with said tube bundles of said second superheating stage.

6. An apparatus according to claim 2, in which at least two tube bundles of said first superheating stage are disposed next to one another.

7. An apparatus according to claim 2, in which at least two tube bundles of said second superheating stage are disposed next to one another.

8. An apparatus according to claim 2, in which at least two tube bundles of said first superheating stage are disposed next to one another, and at least two tube bundles of said second superheating stage are disposed next to one another.

9. An apparatus according to claim 2, in which said tank has an upper end that is provided with outlet means for dry and superheated steam.

* * * * *